US009489812B2

(12) United States Patent
Beagley et al.

(10) Patent No.: US 9,489,812 B2
(45) Date of Patent: Nov. 8, 2016

(54) ACTIVE INFRARED SENSOR

(71) Applicant: Vivint, Inc., Provo, UT (US)

(72) Inventors: James Beagley, Taylorsville, UT (US); Jason C. Flint, Provo, UT (US); Scott Bevan, Lehi, UT (US); Jeffrey Louis Jones, Elk Ridge, UT (US)

(73) Assignee: Vivint, Inc., Provo, UT (US)

( * ) Notice: Subject to any disclaimer, the term of this patent is extended or adjusted under 35 U.S.C. 154(b) by 0 days.

(21) Appl. No.: 14/543,039

(22) Filed: Nov. 17, 2014

(65) Prior Publication Data

US 2016/0140817 A1 May 19, 2016

(51) Int. Cl.

| | |
|---|---|
| ***G08B 13/18*** | (2006.01) |
| ***G08B 13/19*** | (2006.01) |
| ***G08B 13/14*** | (2006.01) |
| ***G08B 13/16*** | (2006.01) |

(52) U.S. Cl.

CPC ..... *G08B 13/19* (2013.01); *G08B 13/1436* (2013.01); *G08B 13/1645* (2013.01)

(58) Field of Classification Search

CPC .. G08B 13/19; G08B 13/186; G08B 13/124; G08B 13/183; G08B 13/19608; G08B 13/181; G08B 13/1436; G08B 13/1645; G08B 13/19602

USPC ..... 340/555–557, 554, 565, 567, 521, 540, 340/541, 511, 522, 573.1; 250/342, 353

See application file for complete search history.

(56) References Cited

U.S. PATENT DOCUMENTS

| | | | | |
|---|---|---|---|---|
| 5,923,250 | A * | 7/1999 | Pildner | G08B 13/191 250/342 |
| 6,912,429 | B1 * | 6/2005 | Bilger | G08B 25/008 236/49.3 |
| 8,130,099 | B2 | 3/2012 | Steinel et al. | |
| 8,305,447 | B1 | 11/2012 | Wong | |
| 2007/0182554 | A1 * | 8/2007 | Elwell | G08B 13/1627 340/567 |
| 2013/0076620 | A1 | 3/2013 | Fukano | |
| 2013/0099922 | A1 | 4/2013 | Lohbihler | |
| 2013/0135118 | A1 * | 5/2013 | Ricci | G06F 9/54 340/932.2 |

FOREIGN PATENT DOCUMENTS

| | | |
|---|---|---|
| WO | 2014126469 | 8/2014 |

* cited by examiner

*Primary Examiner* — Anh V La
(74) *Attorney, Agent, or Firm* — Holland & Hart LLP

(57) ABSTRACT

Methods and systems are described for monitoring a monitored space. An example computer-implemented method for monitoring a monitored space includes periodically emitting with an active infrared sensor a modulated infrared signal into a monitored space being monitored by a home automation system, receiving with the active infrared sensor the modulated infrared signals reflected from objects in the monitored space, and determining at least one of whether a number of objects in the monitored space have changed and whether any of the objects are moving.

20 Claims, 11 Drawing Sheets

ACTIVE INFRARED SENSOR

BACKGROUND

Advancements in media delivery systems and media-related technologies continue to increase at a rapid pace. Increasing demand for media has influenced the advances made to media-related technologies. Computer systems have increasingly become an integral part of the media-related technologies. Computer systems may be used to carry out several media-related functions. The wide-spread access to media has been accelerated by the increased use of computer networks, including the Internet and cloud networking.

Many homes and businesses use one or more computer networks to generate, deliver, and receive data and information between the various computers connected to computer networks. Users of computer technologies continue to demand increased access to information and an increase in the efficiency of these technologies. Improving the efficiency of computer technologies is desirable to those who use and rely on computers.

With the wide-spread use of computers and mobile devices has come an increased presence of home automation and security products. Advancements in mobile devices allow users to monitor and/or control an aspect of a home or business. As home automation and security products expand to encompass other systems and functionality in the home, opportunities exist for improved motion detection and occupancy sensing in monitored spaces monitored by home automation and security products.

SUMMARY

Methods and systems are described for monitoring a monitored space. An example computer-implemented method for monitoring a monitored space includes periodically emitting with an active infrared sensor a modulated infrared signal into a monitored space being monitored by a home automation system, receiving with the active infrared sensor the modulated infrared signals reflected from objects in the monitored space, and determining at least one of whether a number of objects in the monitored space have changed and whether any of the objects are moving.

In one example, the method may include determining a frequency shift in the received modulated infrared signals. The method may include determining whether any of the objects are moving based on the frequency shift. The method may include determining a direction of movement of objects based on the frequency shift. The active infrared sensor may be integrated into a control panel of the home automation system. The determining step may include using Doppler effect, or amplitude modulation, or a combination thereof. The method may include creating a baseline profile of the monitored space based on the received modulated infrared signals, and comparing the baseline profile to future profiles of the monitored space. The active infrared sensor include an emitter configured to emit the modulated infrared signals, and a receiver configured to receive the modulated infrared signals reflected from objects in the monitored space.

Another embodiment is directed to an apparatus for monitoring a monitored space using a home automation system. The apparatus includes a processor, a memory in electronic communication with the processor, and instructions stored in the memory. The instructions being executable by the processor to periodically emit with an active infrared sensor a modulated infrared signal into the monitored space, receive with the active infrared sensor the modulated infrared signals reflected from objects in the monitored space, and determine at least one of a change in a number of objects in the monitored space and a direction of movement of objects in the monitored space using at least one of amplitude modulation and Doppler effect.

In one example, the instructions may be executable by the processor to emit and receive the modulated infrared signals multiple times per second. The instructions may be executable by the processor to determine at least one of presence and direction of movement of two or more objects in the monitored space concurrently. The determining step may include comparing the received modulated infrared signals to one or more baseline signals.

Another embodiment is directed to an active infrared (IR) sensor for use in a home automation and security system. The sensor includes an infrared emitter configured to disperse at least one infrared beam into a monitored space, an infrared receiver configured to receive reflected infrared signals from the monitored space, and a controller. The controller is configured to generate a baseline profile of the monitored space based on the received reflected infrared signals, and compare future profiles to the baseline profile to determine a change in objects present in the monitored space.

In one example, the controller is configured to determine a frequency shift in the received reflected infrared signals. The controller may use the frequency shift to determine a direction of motion of one or more objects in the monitored space. The active infrared sensor may be integrated into a housing of a control panel of the home automation and security system. The infrared emitter may be positioned spaced apart from the infrared receiver on the housing of the control panel. The infrared emitter may emit infrared signals in at least a 180° pattern. The infrared emitter may be configured to emit a modulated infrared signal. The controller may utilize at least one of amplitude modulation and Doppler effect to determine at least one of a direction of motion and a change in the number of objects present in a space monitored by the active infrared sensor.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the spirit and scope of the appended claims. Features which are believed to be characteristic of the concepts disclosed herein, both as to their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the embodiments may be realized by reference to the following drawings. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Figure 1:
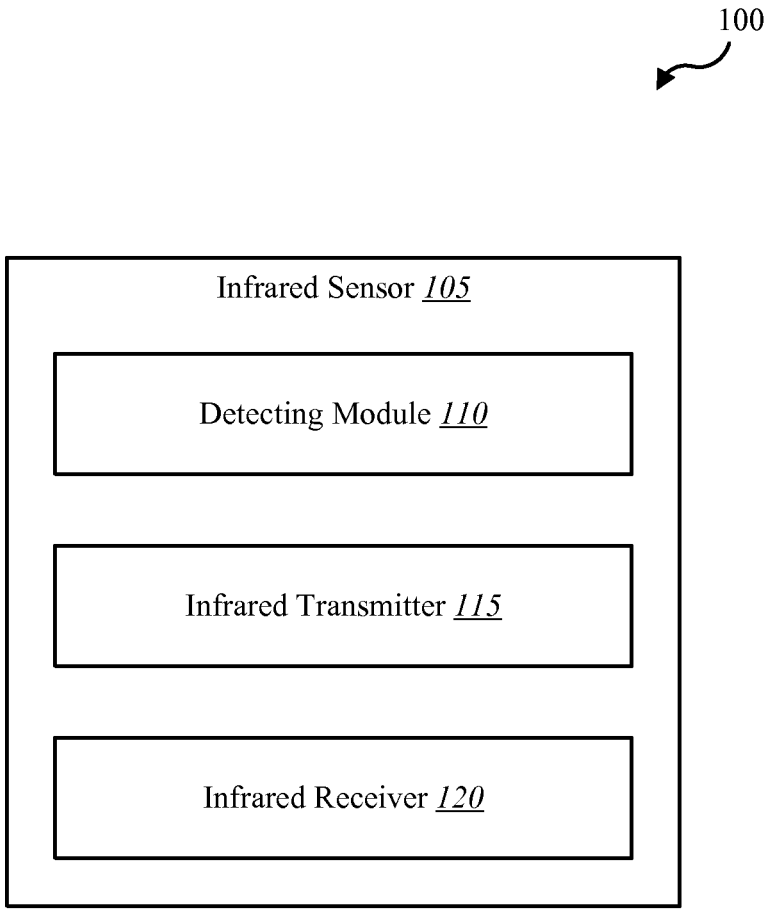
FIG. 1 is a block diagram of an environment in which the present systems and methods may be implemented.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The systems and methods described herein relate to home automation and home security, and related security systems and automation for use in commercial and business settings. As used herein, the phrase "home automation system" may refer to a system that includes automation features alone, security features alone, a combination of automation and security features, or a combination of automation, security and other features. While the phrase "home automation system" is used throughout to describe a system or components of a system or environment in which aspects of the present disclosure are described, such an automation system and its related features (whether automation and/or security features) may be generally applicable to other properties such as businesses and commercial properties as well as systems that are used in indoor and outdoor settings.

Motions sensors are often used in home automation system, and particularly for security features of a home automation system. Motion sensors typically are unable to distinguish between different sources of motion. Further, motions sensors lack the ability to determine which direction an object is moving relative to a reference point such as the sensor itself. Many types of motion sensors have a physical appearance, such as a fish eye, that is undesirable and lacks aesthetic appeal. Infrared technology has been used for many purposes, including heat and sonar sensors. However, known infrared (IR) sensors are inadequate for motion detection, particularly in a home automation and security system setting where there is often limited space for housing/positioning the sensor and the sensor is visible.

The present disclosure is directed to infrared sensors and using infrared sensors to determine motion and/or presence of an object/person. One example of an infrared sensor is an active infrared sensor that utilizes at least one of Doppler effect and amplitude modulation in an active infrared range. An infrared sensor using Doppler effect typically operates by projecting an infrared beam from the sensor into a room, collecting infrared signals that are reflected back to the sensor, creating a profile of the room, and then monitoring for changes in the profile from ongoing projection and reflection of infrared beams.

An infrared sensor using amplitude modulation may operate by projecting an infrared beam from the sensor into a room, and detecting frequency shifts in the infrared signals that are collected by the sensor. The frequency shifts may help determine not only a change in the object within the room, but may also assist in determining the direction in which the object is moving.

In some embodiments, both Doppler effect and amplitude modulation aspects of an active infrared sensor are implemented in combination to enhance the sensor's ability to determine at least one of a change in the number of objects present in a monitored space, and a direction of motion of one or more objects in the monitored space. The transmitting and receiving of infrared signals may be performed periodically, such as 1 to 10 times per second, and the active infrared sensor may be timed out (e.g., a sleep mode) between each duty cycle.

The active infrared sensor may be integrated into a control panel of the home automation system. In some examples, multiple active infrared sensors may be arranged to cover a single area, and/or the monitored area of a plurality of active infrared sensors may overlap in some way. The infrared signals transmitted by the active infrared sensors may be set at specific frequencies or provided with signal signatures that assist with distinguishing between signals from different infrared sensors. The infrared signals may be modulated to help distinguish the sensor generated infrared signals from other types of infrared input in a given area such as ambient light or a heat source.

FIG. 1 is a block diagram illustrating one embodiment of an environment 100 in which the present systems and methods may be implemented. In some embodiments, the systems and methods described herein may be performed at least in part on or using an infrared sensor 105. Infrared sensor 105 may include a detecting module 110, an infrared transmitter 115, and an infrared receiver 120.

Detecting module 110 may provide various functions and include a number of other operational modules as described below with reference to FIGS. 7 and 8. Detecting module 110 may operate to provide detection of one or more objects in a monitored space, and/or determine a direction of motion of one or more objects in the monitored space. Detecting module 110 may operate infrared transmitter 115 and infrared receiver 120. Detecting module 110 may receiver input from one or both of infrared transmitter 115 and infrared receiver 120 as a part of detecting one or more objects in the monitored space and/or determining a direction of motion of one or more objects in the monitored space. Detecting module 110 may generate a notice in response to detecting the objects and/or direction of motion of the objects.

Infrared sensor 105 may be operated, at least in part by transmitting an infrared signal into a monitored space with no predefined target. The infrared transmitter 115 may transmit the infrared signal in all directions with the intent that the infrared signal will reflect or bounce off of many, if not all, exposed surfaces in the monitored space, whether or not those surfaces are directly facing the infrared transmitter 115. The reflected infrared signals are received by infrared receiver 120. The reflected infrared signals that are received by infrared receiver 120 may be used to help determine a baseline for the objects positioned in the monitored space. Each transmit and receive duty cycle may include a comparison of the received reflected infrared signal to the baseline signal as part of determining at least one of whether or not the number of objects in a monitored space has changed and a direction of motion of one or more objects in a monitored space.

The infrared sensor 105 operates at least in part by determining a whole area of reflectivity within the monitored space using a single infrared sensor 105. The single infrared sensor 105 may include one or more infrared transmitters 115 and one or more infrared receivers 120. The total amount of reflectivity within a monitored space changes as objects enter into and depart from the monitored space. When objects are moving within the monitored space, at least some of the reflected infrared signal has a phase shift. This phase shift is used by detecting module 110 to determine a direction of motion toward or away from infrared sensor 105.

Each duty cycle of operation by infrared sensor 105 (i.e., transmitting an infrared signal by infrared transmitter 115 and receiving reflected infrared signals by infrared receiver 120) may be performed relatively quickly (e.g., within milliseconds). Infrared sensor 105 may rest or go into a sleep mode between each duty cycle. In some examples detecting module 110 may perform a short comparison operation to compare the reflected signal received by infrared receiver 120 in each duty cycle to a baseline value, a previously collected reflected signal from the previous duty cycle, or the like. The comparison function may occur between each duty cycle. In some examples, a plurality of duty cycles will occur followed by a comparison operation related to the reflected signals received from that plurality of duty cycles. The comparison operation may involve averaging the reflected signal values from the plurality of duty cycles and comparing the averaged value to a baseline or some other value. In some examples, infrared sensor 105 may operate a plurality of duty cycles within a given time frame such as, for example, within one second, within a 10 second period, or within a one minute period.

Infrared sensor 105 may utilize one or both of Doppler effect and amplitude modulation to determine one or both of the change in objects within a monitored space and a direction of motion of any object in the monitored space. In some examples, one or both of Doppler effect and amplitude modulation may be used to determine whether a plurality of different objects have entered into or departed from a monitored space, and/or determine a direction of motion of a plurality of different objects within a monitored space.

The infrared sensor 105 may operate at least in part to continuously update the baseline against which future reflected infrared signals received by infrared receiver 120 are compared against. Consequently, no fixed or set background barrier is needed as part of set up for calibrating the infrared sensor 105. Eliminating such set up or calibration may reduce the power requirements, time between duty cycles, complexity of operation, and other aspects of infrared sensor 105 as compared to other types of sensors.

In some embodiments, infrared transmitter 115 may include a ring-shaped structure, such as a lens having a raised toroidal ring construction, that enhances projection of the infrared signal into a monitored space. Infrared receiver 120 may have any desired shape, size and orientation. In one example, infrared receiver 120 is positioned behind a transparent structure such as a glass or plastic face of infrared sensor 105 or a control panel for a home automation system.

Typically, the infrared transmitter 115 and infrared receiver 120 are physically spaced apart from each other so that the transmitted infrared signal is not collected or received at infrared receiver 120 until after the signal has reflected off of a surface within the monitored space that is located away from infrared sensor 105. In one example, infrared transmitter 115 is positioned at one location on a housing of infrared sensor 105, and infrared receiver 120 is positioned at another location on the housing that is physically spaced apart from infrared transmitter 115. In another example, infrared transmitter 115 is positioned at one location on a control panel housing of a home automation system, and infrared receiver 120 is positioned at a separate, spaced apart location on the control panel housing.

The infrared signal transmitted by infrared transmitter 115 may be modulated as described above. The modulating may include frequency modulation. The modulation may occur digitally and may include digital amplitude modulating of the frequency. With this type of frequency modulating control, it may be possible to provide a distinct fingerprint or identity to the infrared signal transmitted by each infrared sensor 105. Further, the modulating aspect of the signal helps to distinguish an infrared signal transmitted by infrared sensor 105 from other sources of infrared light including, for example, ambient light or infrared signals from other infrared sensors. Infrared sensor 105 is able to distinguish between those infrared signals transmitted by infrared transmitter 115 and other infrared signals and ignore the other infrared signals. Both frequency modulation and amplitude modulation may be implemented as part of creating the unique infrared signal generated by and transmitted from the infrared transmitter 115.

Figure 2:
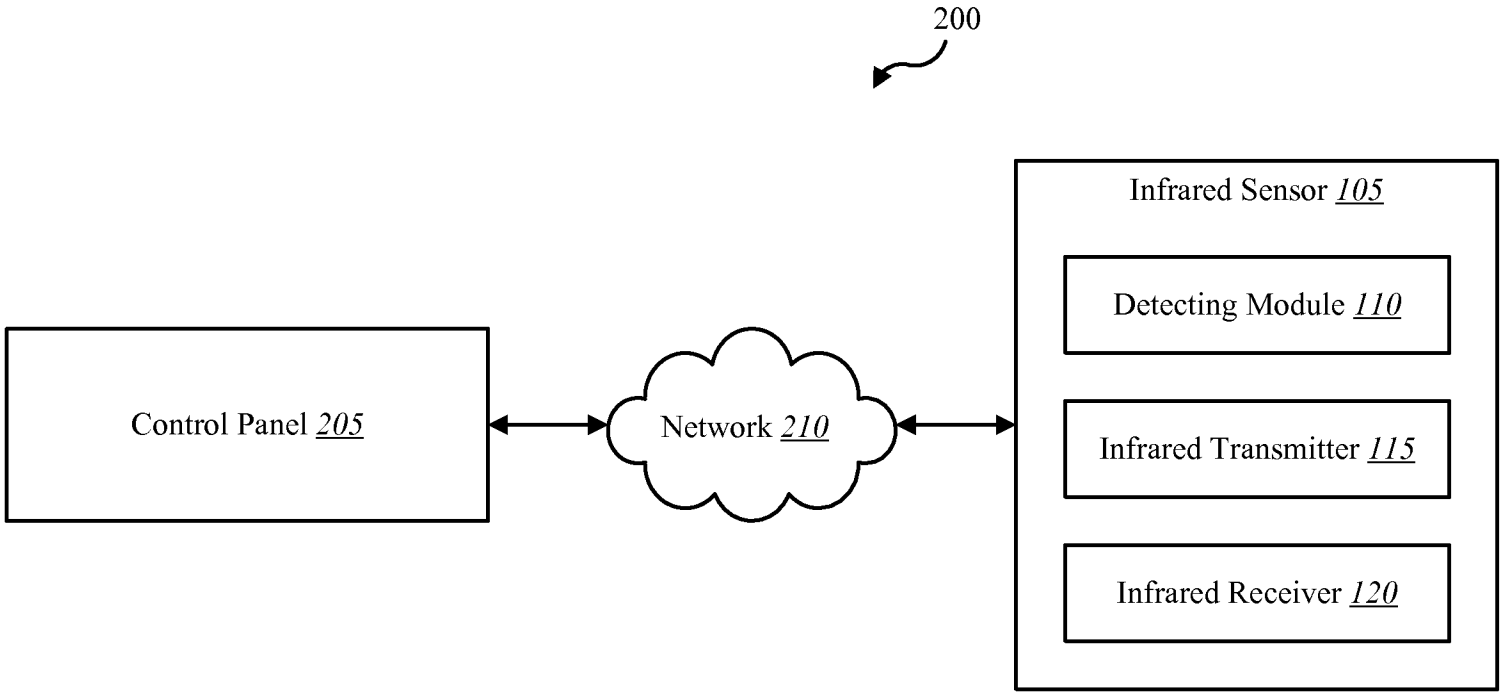
FIG. 2 is a block diagram of another environment in which the present systems and methods may be implemented.

FIG. 2 is a block diagram illustrating one embodiment of an environment 200 in which the present systems and methods may be implemented. Environment 200 may include the same or similar components as discussed above related to environment 100. In some environments, the systems and methods described herein may be performed at least in part on or using infrared sensor 105 that communicates via a network 210 with a control panel 205. Infrared sensor 105 may include the detecting module 110, infrared transmitter 115, and infrared receiver 120 described above.

Infrared sensor 105 may be in communication with control panel 205 as part of operation of a home automation system. Control panel 205 may be located within the monitored area of infrared sensor 105. Alternatively, infrared sensor 105 may be positioned in a different room or different building relative to control panel 205 and may communicate with control panel 205 via network 210. Environment 200 may include the home automation system or at least portions thereof. The home automation system may be operable in association with a single property that may include a plurality of buildings, monitored spaces, and/or spaces monitored by one or more infrared sensors 105. The determined number of objects in a monitored space and/or a direction of motion of any objects in a monitored spaced may be transmitted to control panel 205. Control panel 205 may operate to determine whether the objects that have entered into or departed from the monitored space are authorized to do so. Information about the direction of motion of one or more objects in a monitored space may be used by control panel 205 to determine whether the motion is authorized.

The detection of objects and/or direction of motion of objects may be used by control panel 205 as part of determining patterns of behavior. The patterns of behavior may be used to provide other functionality of the home automation system, such as automatically turning on/off security features, arming/disarming a security function, locking/unlocking doors, sending notices to a user at a remote location, and the like.

In some embodiments, environment 200 may include a plurality of control panels 205, wherein some of the control panels are slaves to a main or primary control panel. Infrared sensor 105 may communicate with one or more of the control panels directly or indirectly. In one example, infrared sensor 105 is dedicated to a specific room and control panel 205 is also dedicated to that specific room.

Network 210 may utilize any available communication technology such as, for example, Bluetooth, Zigby, Z-wave, infrared (IR), radio frequency (RF), near field communication (NFC), or other short distance communication technologies. In other examples, network 210 may include cloud networks, local area networks (LAN), wide area networks (WAN), virtual private networks (VPN), wireless networks (using 802.11 for example), and/or cellular networks (e.g., using 3G and/or LTE), etc. In some embodiments, network 210 may include the internet.

Figure 3:
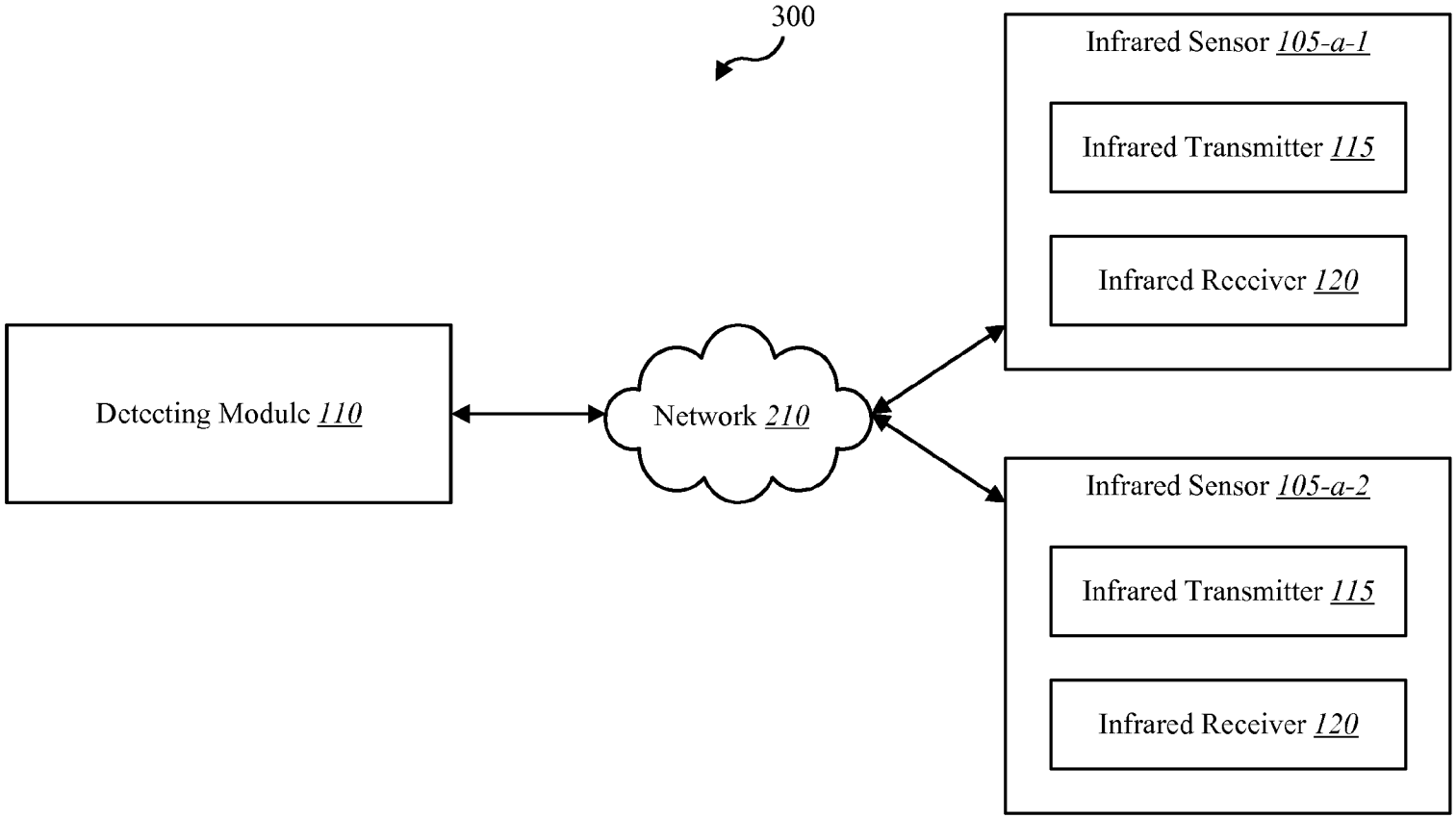
FIG. 3 is a block diagram of another environment in which the present systems and methods may be implemented.

FIG. 3 is a block diagram illustrating one embodiment of an environment 300 in which the present systems and methods may be implemented. Environment 300 may include at least some of the components of environments 100, 200, described above. Environment 300 may include detecting module 110 provided separate from a plurality of infrared sensors 105-*a*. Each infrared sensor 105-*a* may include an infrared transmitter 115 and an infrared receiver 120. Detecting module 110 may control at least in a part each of infrared sensors 105-*a*. In some embodiments, infrared receivers 120 transmit information about reflected infrared signals received by infrared receivers 120 to detecting module 110. Detecting module 110 may determine presence of at least one of a number of objects in a monitored space and the direction of motion of one or more objects in the monitored space based on the infrared signals received from infrared receivers 120. Information transmitted to detecting module 110 from each of infrared sensors 105-*a* may include, for example, information about the infrared signals that are transmitted by infrared transmitter 115 (e.g., an amplitude modulation or frequency modulation, how often the infrared signals are transmitted in a given time period by infrared transmitter 115, and information about a location of infrared sensors 105-*a*).

Detecting module 110 may be located or housed physically separated from infrared sensors 105-*a*. In one example, detecting module 110 is included with a control panel of a home automation system, and infrared sensors 105-*a* are positioned in separate monitored spaces from the control panel, or in the same monitored space as the control panel but physically separated from infrared sensors 105-*a*. While two infrared sensors 105-*a* are illustrated, three or more infrared sensors 105-*a* may be in communication with and/or controlled at least in part by detecting module 110.

Figure 4:
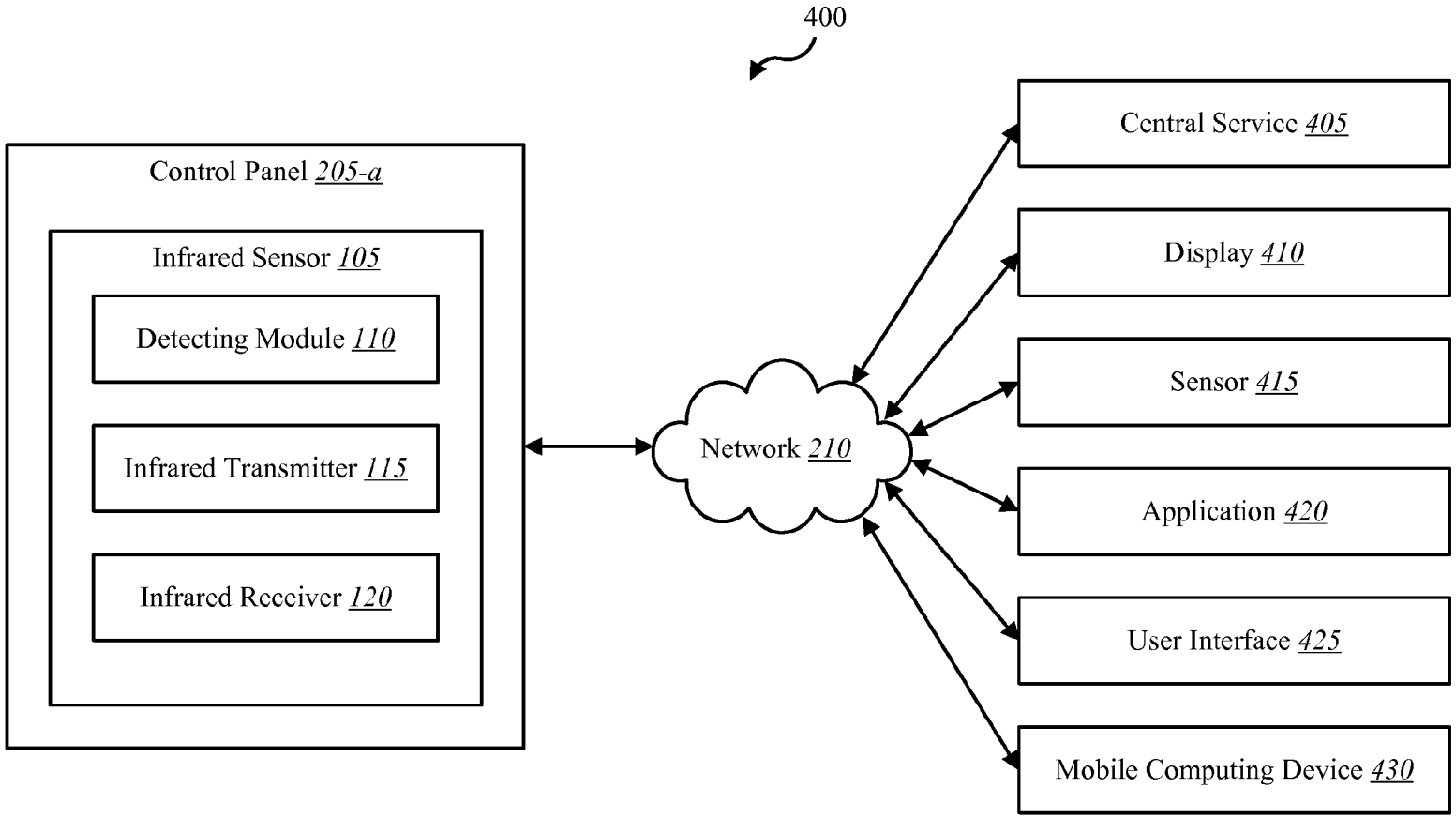
FIG. 4 is a block diagram of another environment in which the present systems and methods may be implemented.

FIG. 4 is a block diagram illustrating one embodiment of an environment 400 in which the present systems and methods may be implemented. Environment 400 may include at least some of the same components of the environment's 100, 200, 300 described above. Environment 400 may include a control panel 205-*a* that includes an infrared sensor 105 having a detecting module 110, an infrared transmitter 115, and an infrared receiver 120. Environment 400 may also include a central service 405, a display 410, a sensor 415, an application 420, a user interface 425, and a mobile computing device 430. The components of environment 400 may be arranged in communication with each other via network 210.

Central service 405 may provide back-up services in support of control panel 205-*a* and/or a home automation system that includes control panel 205-*a*. Central Service 405 may be located at a remote location from control panel 205-*a*. Central service 405 may provide back-up storage capacity, customer service, and the like. In some embodiments, control panel 205-*a* may operate to determine that at least one of the objects that enters into monitored space as determined by detecting module 110 is unauthorized, and control panel 205-*a* sends an alarm signal to central service 405. The alarm signal may prompt central service 405 to contact emergency personnel or a home owner, or place a phone call to the property being monitored.

Display 410, sensor 415, application 420, and user interface 425 may be located physically at a property being monitored by the home automation system. Display 410 may provide user interface 425 for a user to control aspects of the home automation system. While display 410 and user interface 425 are shown as separate components from control panel 205-*a* and infrared sensor 105, other embodiments may include at least one of display 410 and user interface 425 as part of infrared sensor 105 or control panel 205-*a*. Display 410 and/or user interface 425 may facilitate a user's interaction with infrared sensor 105, such as to provide adjustment of one or more settings of infrared sensor 105 and/or control panel 205-*a*.

Sensor 415 may include, for example, a camera sensor, an audio sensor, a forced entry sensor, a shock sensor, a proximity sensor, a boundary sensor, an appliance sensor, a light fixture sensor, a temperature sensor, a light beam sensor, a three-dimensional (3D) sensor, a motion sensor, a smoke sensor, a glass break sensor, a door sensor, a video sensor, a carbon monoxide sensor, an accelerometer, a global positioning system (GPS) sensor, a Wi-Fi positioning sensor, a capacitance sensor, a radio frequency sensor, a near-field sensor, a heartbeat sensor, a breathing sensor, an oxygen sensor, a carbon dioxide sensor, a brainwave sensor, a voice sensor, a touch sensor, and the like. Control panel 205-*a* may include one or more of sensors 415. Although sensor 415 is depicted as a separate component from control panel 205-*a*, in some embodiments, sensor 415 may be connected directly to any one of the components of environment 400. Additionally, or alternatively, sensor 415 may be integrated into a home appliance or fixture. Sensor 415 may cooperate with infrared sensor 105 to determine or confirm motion in the monitored area, or other desired information.

Application 420 may allow a user (e.g., a user interfacing directly with control panel 205-*a* located at a property being monitored by the home automation system) to control, either directly or via control panel 205-*a* and/or a separate computing device, an aspect of the monitored property including, for example, security, energy management, locking and unlocking doors, checking the status of the doors, locating a user or item, controlling lighting, thermostat, or cameras and receiving notifications regarding a current status or anomaly associated with a home, office, place of business, or the like (e.g., a property). In some configurations, application 420 may enable control panel 205-*a* to communicate with control panel 205-*a*, infrared sensor 105, central service 405, display 410, sensor 415, user interface 425, or mobile computing device 430, as well as other devices or systems. In one example, application 420 may provide the user interface 425 to display an automation, security, and/or energy management content on control panel 205-*a*. Thus, application 420, via user interface 425, may allow users to control aspects of their home, office, and/or other type of property, as well as control generation, delivery, and responses to messages from detecting module 110. Further, application 420 may be installed on control panel 205-*a* or other components and/or features of the home automation system. Control panel 205-*a* may carry out at least some functionality of detecting module 110. For example, application 420 may provide two-way communication between detecting module 110 and infrared sensor 105, delivery of a message from detecting module 110 to another location (e.g., mobile computing device 430), and the like.

Mobile computing device 430 may be carried by a user of the home automation system (e.g., a property owner or manager). Control panel 205-*a* and/or detecting module 110 may communicate information to the mobile computing device 430 about the objects and/or movement of objects in the monitored space. In some embodiments, mobile computing device 430 may facilitate adjustment of setting of the home automation system from a remote location, such as remote adjustment of settings of control panel 205-*a* or infrared sensor 105.

Figure 5:
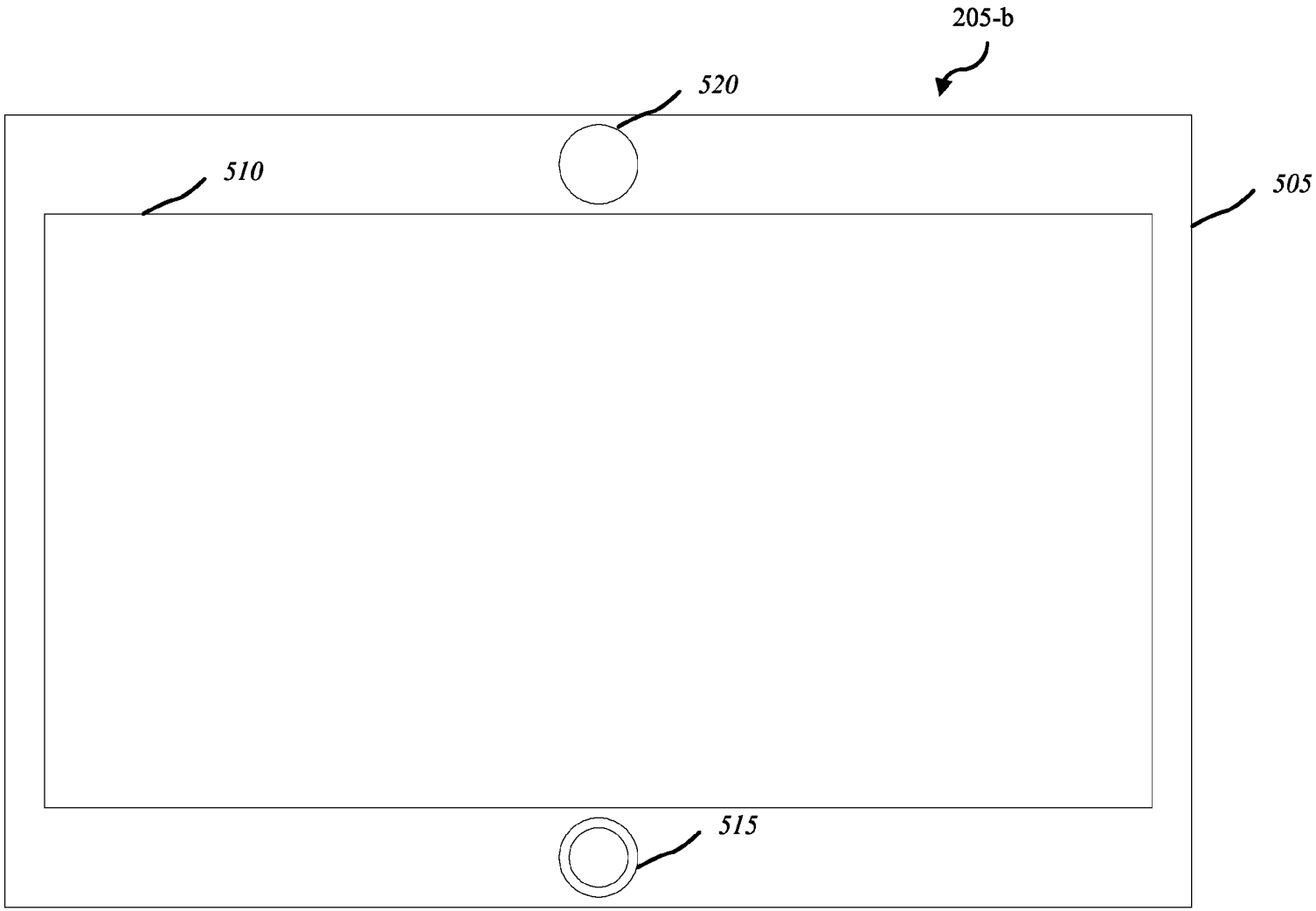
FIG. 5 schematically illustrates a control panel in which the present systems and methods may be implemented.

FIG. 5 is a schematic front view of an example control panel 205-*b* in accordance with the present disclosure. Control panel 205-*b* includes a housing 505, a monitor 510, an infrared transmitter 515, and an infrared receiver 520. The infrared transmitter 515 is physically spaced apart from the infrared receiver 520. Other arrangements are possible for the infrared transmitter 515 and infrared receiver 520 including, for example, positioning both of those components along a bottom portion of housing 505 or along a top portion of the housing 505, positioned along sides of housing 505 adjacent to side edges of monitor 510, and the like. The further the infrared transmitter 515 and infrared receiver 520 are spaced apart from each other, the less likely it is that infrared receiver 520 will receive unreflected infrared signals directly from infrared transmitter 515 without the infrared signals being first reflected from an object in the monitored space.

Figure 6:
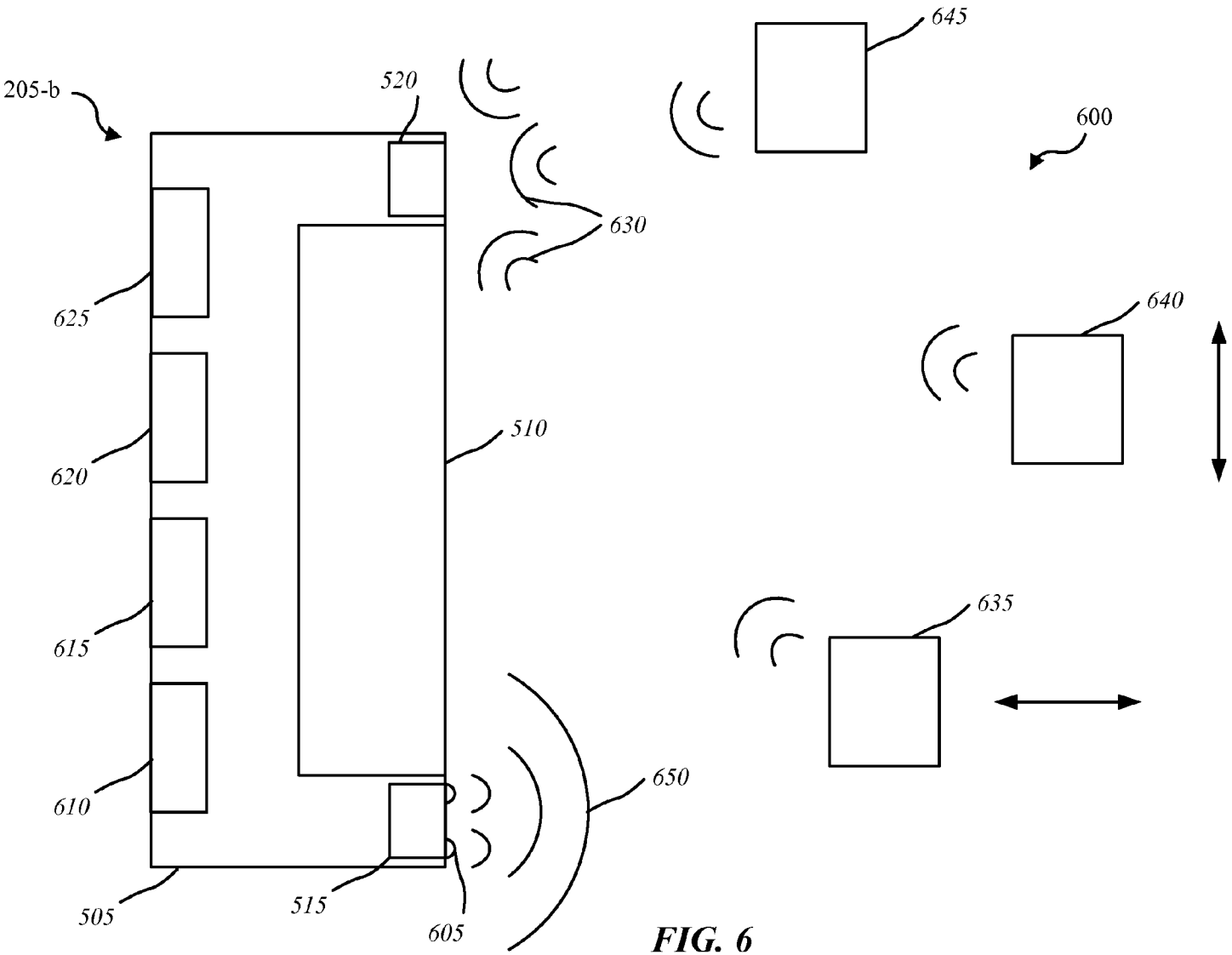
FIG. 6 schematically illustrates a cross-sectional view of the control panel of FIG. 5 in an environment in which the present systems and methods may be implemented.

FIG. 6 illustrates an environment 600 having a schematic cross-sectional view of the control panel 205-*b* shown in FIG. 5, which is operable to transmit infrared signals to and receive reflected infrared signals from a plurality of objects 635, 640, 645. Control panel 205-*b* includes, in addition to housing 505, monitor 510, infrared transmitter 515, and infrared receiver 520, a transmitter lens 605, a power source 610, a controller 615, memory 620 and a transceiver 625.

Lens 605 may be arranged in alignment with infrared transmitter 515 so that infrared signals 650 transmitted therefrom are projected through a 180 degree angle relative to the front face of control panel 205-*b*. The transmitted infrared signal 650 is transmitted into the monitored area in which objects 635, 640, 645 are located. The transmitted infrared signal 650 is reflected off the objects 635, 640, 645 as a reflected signal 630 that is received at infrared receiver 520. The net amplitude of the reflected signal may be used to determine whether objects have been added to or taken away from the monitored space. An offset frequency in a reflected signal received at infrared receiver 520 may be used to determine a direction of motion of one or more of the objects 635, 640, 645 within the monitored area.

Detecting module 110 may be operated at least in part on controller 615. At least some of the data received by control panel 205-*b* (e.g., amplitude, frequency offset, etc., for the reflected signals received at infrared receiver 520) may be stored in memory 620. Transceiver 625 may transmit and/or receive information to/from control panel 205-*b* or to central service 405.

Lens 605 is shown in FIG. 6 having a contoured shape. Lens 605 may have a toroidal, bulbous shape that promotes transmitting a wide angle of infrared signal. The transmitted infrared signal may be in the form of infrared light. Infrared transmitter 515 may be positioned physically behind lens 605 in order to deliver and/or project the infrared light into lens 605 for distribution through lens 605 at a wide angle.

Infrared receiver 520 may have a receiving or collecting surface that is arranged parallel with the front surface of control panel 205-*b*. Infrared receiver 520 may receive the reflected infrared signals through a transparent surface such as, for example, a plane of glass or plastic surface along a front face of control panel 205-*b*. Typically, infrared receiver 520 is oriented facing a majority of the surfaces and/or objects in the monitored space so as to have the best opportunity to receive a reflected infrared signal. However, infrared receiver 520 may be positioned at any location and/or orientation on or around control panel 205-*b*. One or both of infrared transmitter 515 and infrared receiver 520 may be positioned outside of or physically separated from housing 505. In some examples, the physical separation between infrared transmitter 515 and infrared receiver 520 that is needed for best performance of the infrared sensor may be provided by interposing monitor 510 between the infrared transmitter 515 and infrared receiver 520 as shown in FIGS. 5 and 6.

Figure 7:
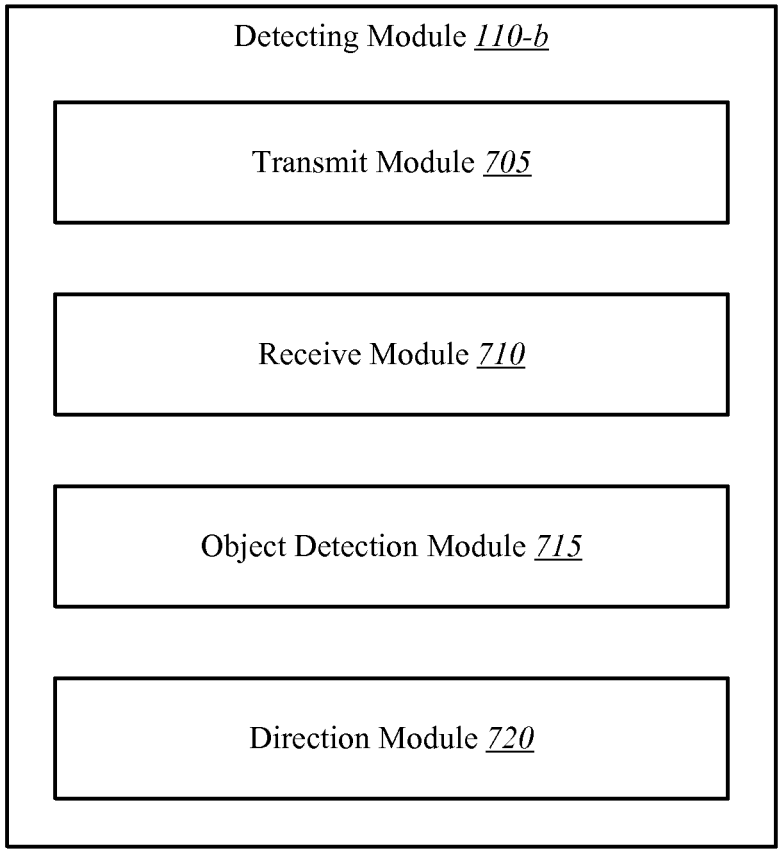
FIG. 7 is a block diagram of a detecting module for use with the environments of FIGS. 1-6.

FIG. 7 is a block diagram illustrating an example detecting module 110-*a*. Detecting module 110-*a* may be one example of the detecting module 110 described above with reference to FIGS. 1-4. Detecting module 110-*a* may include a transmit module 705, a receive module 710, an object detection module 715, and a direction module 720. Transmit module 705 may operate in cooperation with the infrared transmitter of an infrared sensor as described above. The transmit module 705 may provide instructions for operation of the infrared transmitter. Transmit module 705 may communicate information about operation of the infrared transmitter such as, for example, performance and/or maintenance information. Detecting module 110-*a* may provide instructions for updating the infrared transmitter via transmit module 705 such as setting a frequency, an amplitude, or time period between transmissions.

Receive module 710 may operate in cooperation with the infrared receiver of the infrared sensor described above. Receive module 710 may communicate information about the received infrared signal such as, for example, a frequency offset, an amplitude, or a time period between received infrared signals. Receive module 710 may operate at least in part to control operation of the infrared receiver and/or deliver information about performance or maintenance for the infrared receiver.

Object detection module 715 may operate to determine whether one or more objects have been added to or removed from a monitored space. Object detection module 715 may determine the presence of objects based at least in part on Doppler effect, amplitude modulation, or a combination thereof. Object detection module 715 may operate to determine in the aggregate whether any object has been added to or removed from a monitored space. In other examples, object detection module 715 may track each individual object that moves into or out of the space. For example, object detection module 715 may determine when a first object enters the monitored space, and then determine when a second object has entered the monitored space while the first object remains in the space. Object detection module 715 may similarly determine and keep track of when the first and second objects depart from the monitored space, or when a third or additional object enters or departs from the monitored space.

Direction module 720 may operate to determine a direction of motion of one or more objects within the monitored space. Direction module 720 may determine a direction of motion of two or more objects within a monitored space. For example, direction module 720 may determine when an object (e.g., a person) moves through a doorway into a room, which is the monitored space, and determine when the object moves in an opposite direction out of the doorway to leave the room.

Figure 8:
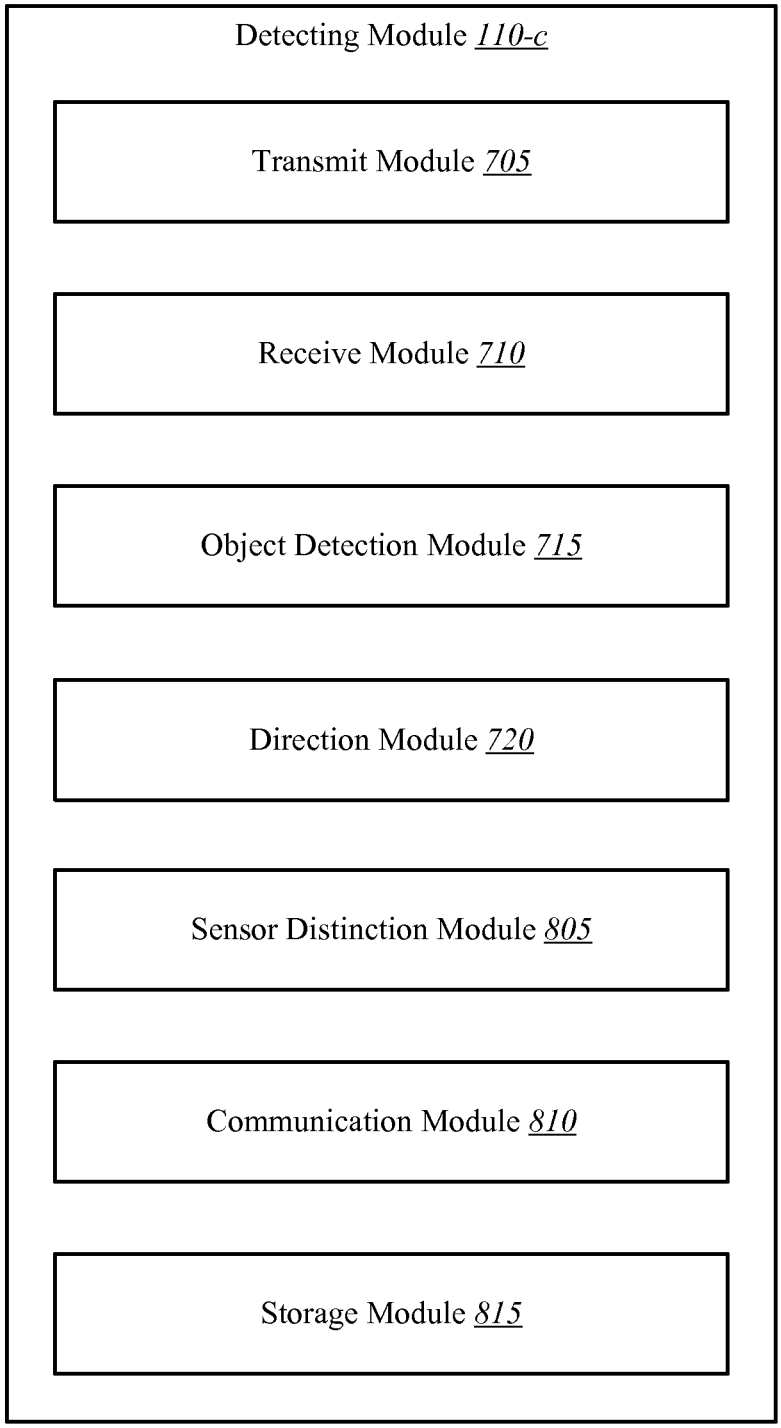
FIG. 8 is a block diagram of another detecting module for use with the environments of FIGS. 1-6.

FIG. 8 is a block diagram illustrating an example detecting module 110-*c*. Detecting module 110-*c* may be one example of the detecting module 110 described above with reference to FIGS. 1-4. Detecting module 110-*c* may include, in addition to transmit module 705, receive module 710, object detection module 715 and direction module 720, a sensor distinction module 805, a communication module 810 and a storage module 815.

Sensor distinction module 805 may operate to distinguish between transmitted infrared signals from different infrared sensors. Sensor distinction module 805 may operate to ignore infrared sensor signals from other infrared sensors that do not match the signal characteristics for a particular infrared sensor to which detecting module 110-*c* is associated. Sensor distinction module 805 may also distinguish between infrared signals from other sources besides other sensors, such as, for example, ambient light, heat sources, and the like.

Communication module 810 may operate to communicate information about a particular infrared sensor to other locations such as, for example, a control panel, a central service, or a remote computing device carried by one or more users. Communication module 810 may operate to receive information for infrared sensors such as, for example, instructions regarding an on/off state, one or more settings, or requests for information regarding maintenance or performance of the infrared sensor.

Storage module 815 may operate to store information related to the infrared sensor. For example, storage module 815 may store for at least a predetermined time period or number of duty cycles, the baseline reflected infrared sensor signal, other reflected infrared signal information, and the like.

Figure 9:
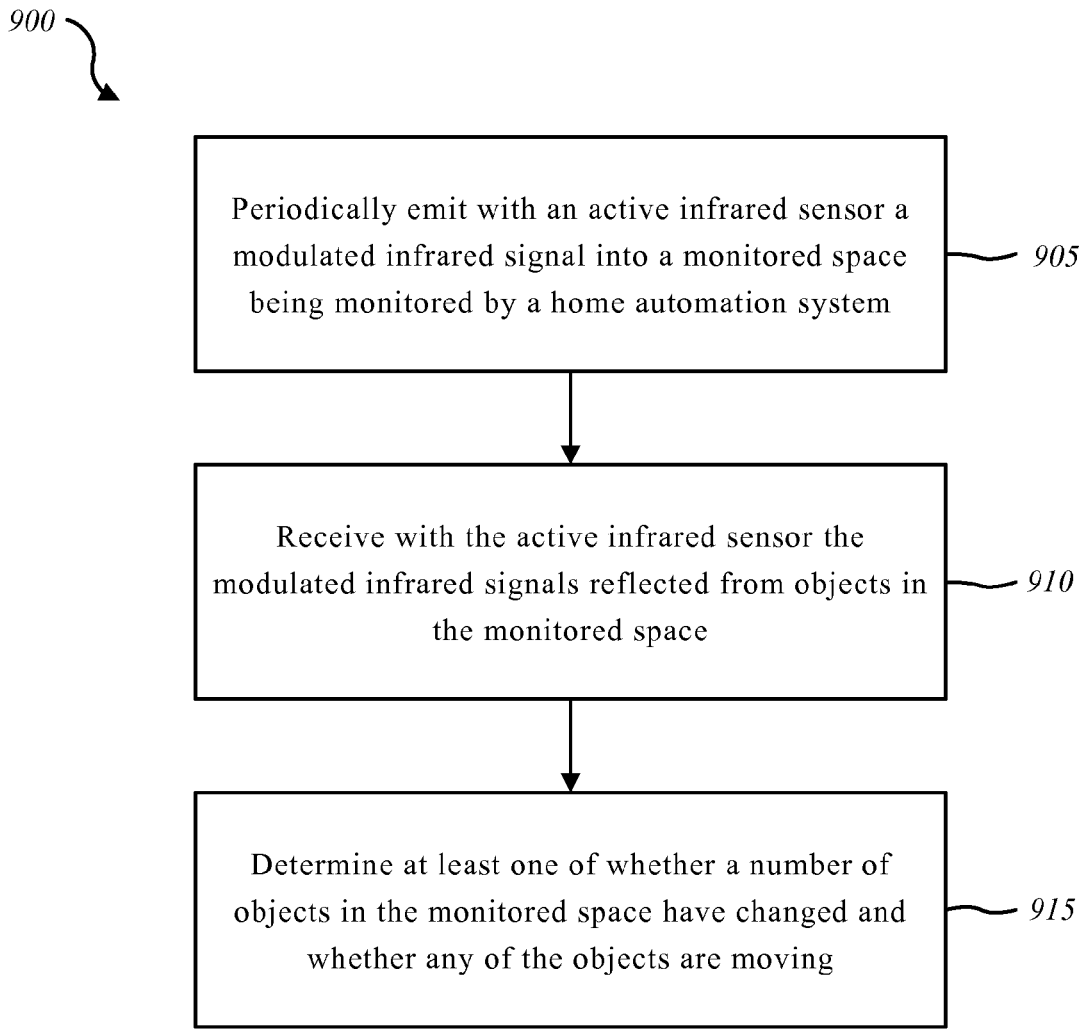
FIG. 9 is a flow diagram illustrating a method for monitoring a monitored space.

FIG. 9 is a flow diagram illustrating one embodiment of a method 900 for monitoring a monitored space. In some configurations, the method 900 may be implemented by the detecting module 110 shown and described with reference to FIGS. 1-4. In other examples, the method 900 may be performed generally by infrared sensor 105 shown in FIGS. 1-6, or even more generally by environments 100, 200, 300, 400 shown in FIGS. 1-4.

Block 905 of method 900 includes periodically emitting with an active infrared sensor a modulated infrared signal into a monitored space being monitored by a home automation system. Block 910 includes receiving with the active infrared sensor the modulated infrared signal as reflected from objects in the monitored space. Block 915 includes determining at least one of whether the number of objects in the monitored space have changed and whether any of the objects are moving.

The method 900 may also include determining a frequency shift of the received modulated infrared signals. The method 900 may include determining whether any of the objects are moving based on the frequency shift. Method 900 may include determining a direction of movement of the objects based on the frequency shift. The active infrared sensor may be integrated into a control panel of the home automation system. The determining step may include using Doppler effect, or amplitude modulation, or a combination thereof. Method 900 may include creating a baseline profile of the monitored space based on the received modulated infrared signals, and comparing the baseline profile to future profiles of the monitored space. The active infrared sensor may include an emitter configured to emit the modulated infrared signals, and a receiver configured to receive the modulated infrared signals reflected from objects in the monitored space.

Figure 10:
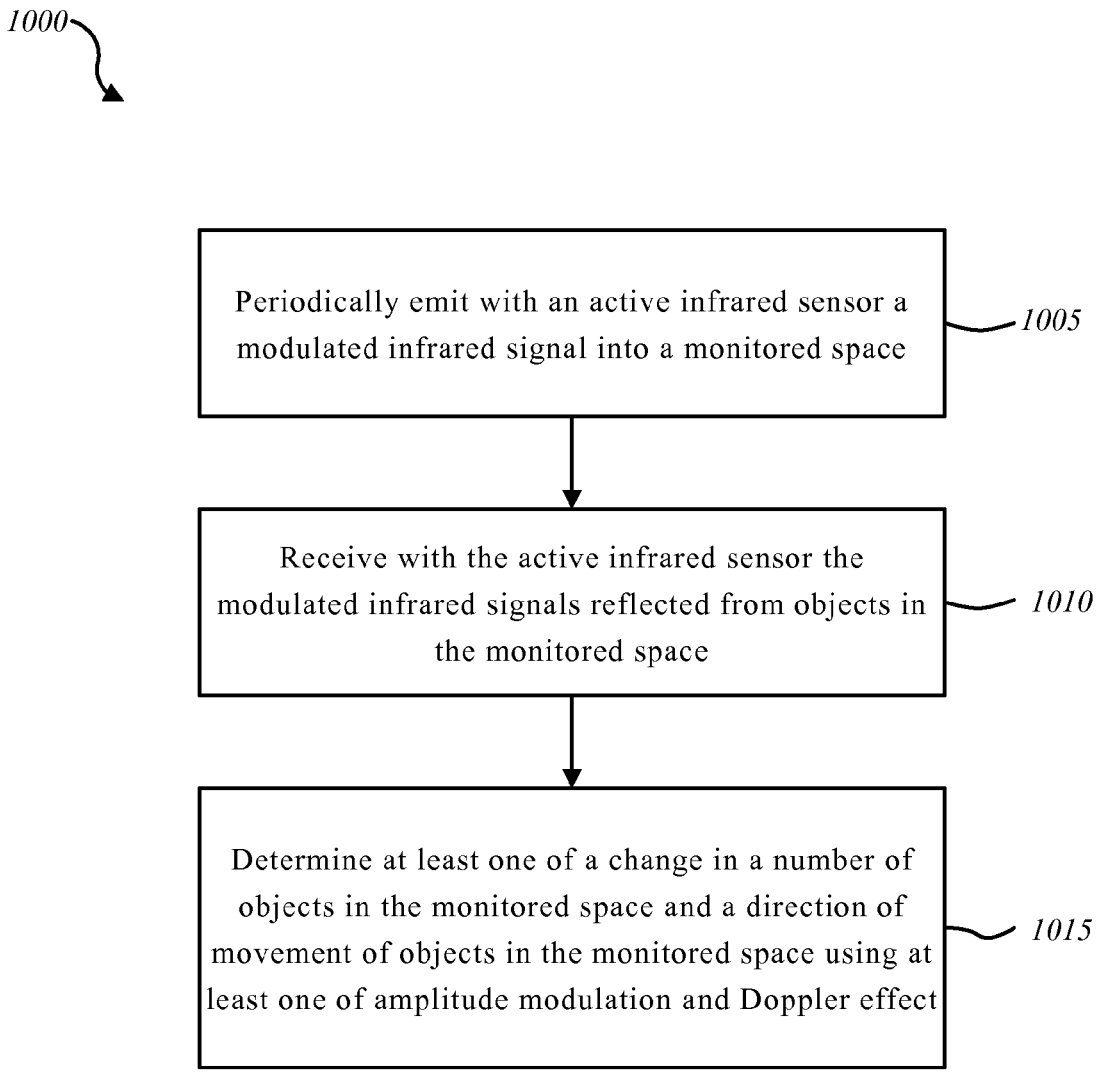
FIG. 10 is a flow diagram illustrating another method for monitoring a monitored space using a home automation system.

FIG. 10 is a flow diagram illustrating one embodiment of a method 1000 for monitoring a monitored space using a home automation system. In some configurations, the method 1000 may be implemented by the detecting module 110 shown and described with reference to FIGS. 1-4. In other examples, the method 1000 may be performed generally by infrared sensor 105 shown in FIGS. 1-6, or even more generally by environments 100, 200, 300, 400 shown in FIGS. 1-4.

Block 1005 of method 1000 includes periodically emitting with an active infrared sensor a modulated infrared signal into a monitored space. Block 1010 includes receiving with the active infrared sensor the modulated infrared signals reflected from objects in the monitored space. Block 1015 includes determining at least one of a change in the number of objects in the monitored space and a direction of movement of objects in the monitored space using at least one of amplitude modulation and Doppler effect.

Method 1000 may include emitting and receiving the modulated infrared signals multiple times per second. Method 1000 may include determining at least one of presence and direction of movement of two or more objects in the monitored space concurrently. The determining step may include comparing the received modulated infrared signals to one or more baseline signals.

Figure 11:
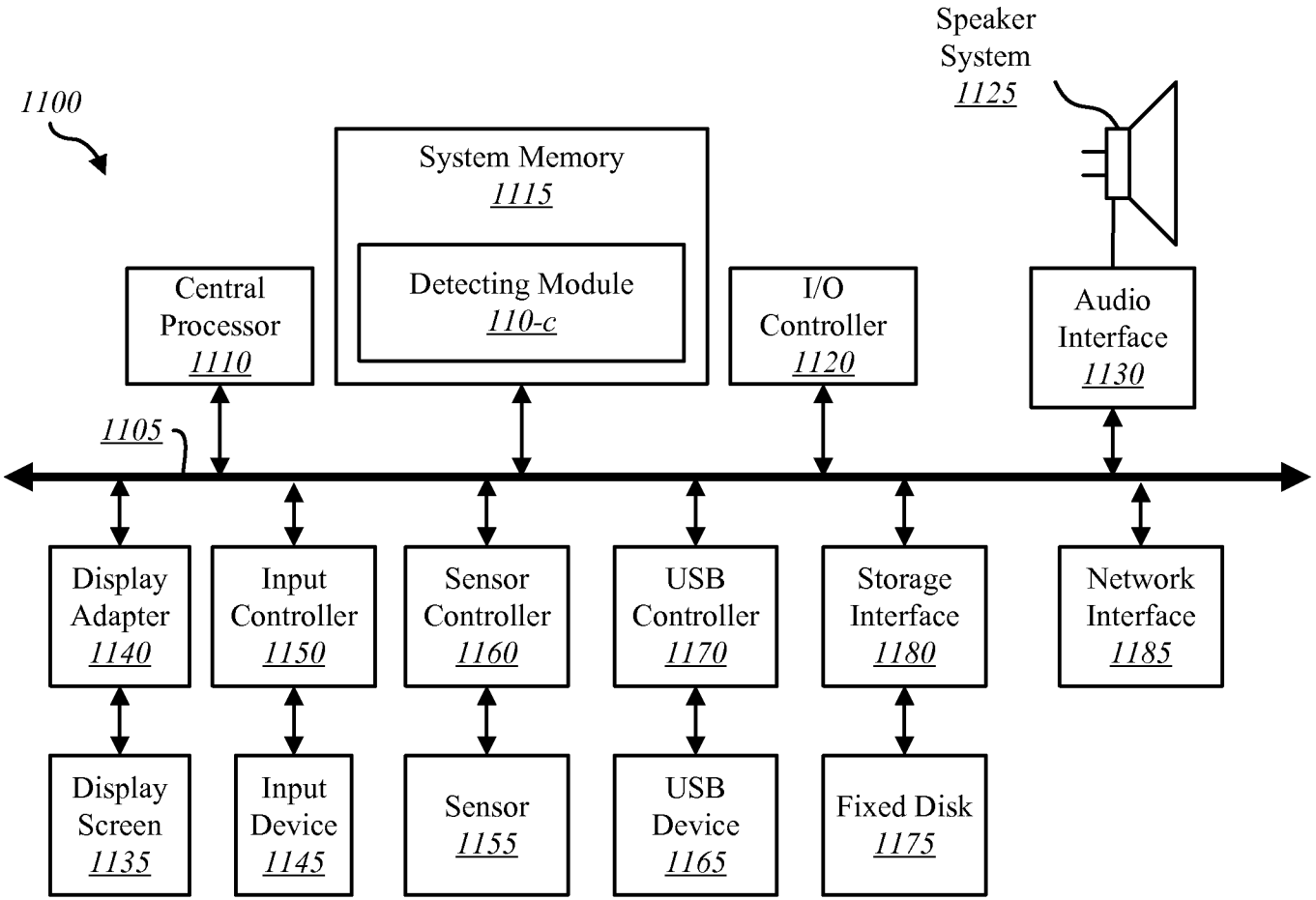
FIG. 11 is a block diagram of a computer system suitable for implementing the present systems and methods of FIGS. 1-10.

FIG. 11 depicts a block diagram of a controller 1100 suitable for implementing the present systems and methods. In one configuration, controller 1100 includes a bus 1105 which interconnects major subsystems of controller 1100, such as a central processor 1110, a system memory 1115 (typically RAM, but which may also include ROM, flash RAM, or the like), an input/output controller 1120, an external audio device, such as a speaker system 1125 via an audio output interface 1130, an external device, such as a display screen 1135 via display adapter 1140, an input device 1145 (e.g., remote control device interfaced with an input controller 1150), multiple USB devices 1165 (interfaced with a USB controller 1170), and a storage interface 1180. Also included are at least one sensor 1155 connected to bus 1105 through a sensor controller 1160 and a network interface 1185 (coupled directly to bus 1105).

Bus 1105 allows data communication between central processor 1110 and system memory 1115, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, the detecting module 110-*c* to implement the present systems and methods may be stored within the system memory 1115. Applications resident with controller 1100 are generally stored on and accessed via a non-transitory computer readable medium, such as a hard disk drive (e.g., fixed disk drive 1175) or other storage medium. Additionally, applications can be in the form of electronic signals modulated in accordance with the application and data communication technology when accessed via network interface 1185.

Storage interface 1180, as with the other storage interfaces of controller 1100, can connect to a standard computer readable medium for storage and/or retrieval of information, such as a fixed disk drive 1175. Fixed disk drive 1175 may be a part of controller 1100 or may be separate and accessed through other interface systems. Network interface 1185 may provide a direct connection to a remote server via a direct network link to the Internet via a POP (point of presence). Network interface 1185 may provide such connection using wireless techniques, including digital cellular telephone connection, Cellular Digital Packet Data (CDPD) connection, digital satellite data connection, or the like. In some embodiments, one or more sensors (e.g., motion sensor, smoke sensor, glass break sensor, door sensor, window sensor, carbon monoxide sensor, and the like) connect to controller 1100 wirelessly via network interface 1185.

Many other devices or subsystems (not shown) may be connected in a similar manner (e.g., entertainment system, computing device, remote cameras, wireless key fob, wall mounted user interface device, cell radio module, battery, alarm siren, door lock, lighting system, thermostat, home appliance monitor, utility equipment monitor, and so on). Conversely, all of the devices shown in FIG. 11 need not be present to practice the present systems and methods. The devices and subsystems can be interconnected in different ways from that shown in FIG. 11. The aspect of some operations of a system such as that shown in FIG. 11 are readily known in the art and are not discussed in detail in this application. Code to implement the present disclosure can be stored in a non-transitory computer-readable medium such as one or more of system memory 1115 or fixed disk drive 1175. The operating system provided on controller 1100 may be iOS®, ANDROID®, MS-DOS®, MS-WINDOWS®, OS/2®, UNIX®, LINUX®, or another known operating system.

Moreover, regarding the signals described herein, those skilled in the art will recognize that a signal can be directly transmitted from a first block to a second block, or a signal can be modified (e.g., amplified, attenuated, delayed, latched, buffered, inverted, filtered, or otherwise modified) between the blocks. Although the signals of the above described embodiment are characterized as transmitted from one block to the next, other embodiments of the present systems and methods may include modified signals in place of such directly transmitted signals as long as the informational and/or functional aspect of the signal is transmitted between blocks. To some extent, a signal input at a second block can be conceptualized as a second signal derived from a first signal output from a first block due to physical limitations of the circuitry involved (e.g., there will inevitably be some attenuation and delay). Therefore, as used herein, a second signal derived from a first signal includes the first signal or any modifications to the first signal, whether due to circuit limitations or due to passage through other circuit elements which do not change the informational and/or final functional aspect of the first signal.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon."

What is claimed is:

1. A computer implemented method for monitoring a monitored space, comprising:

periodically emitting with an active infrared sensor a modulated infrared signal into the monitored space being monitored by a home automation system;

receiving with the active infrared sensor the modulated infrared signals reflected from objects in the monitored space; and determining whether a number of objects in the monitored space has changed and whether any of the objects are moving.

2. The method of claim 1, further comprising:

determining a frequency shift in the received modulated infrared signals.

3. The method of claim 2, further comprising:

determining whether any of the objects are moving based on the frequency shift.

4. The method of claim 2, further comprising:

determining a direction of movement of the objects based on the frequency shift.

5. The method of claim 1, wherein the active infrared sensor is integrated into a control panel of the home automation system.

6. The method of claim 1, wherein the determining step includes using Doppler effect, or amplitude modulation, or a combination thereof.

7. The method of claim 1, further comprising:

creating a baseline profile of the monitored space based on the received modulated infrared signals; and comparing the baseline profile to future profiles of the monitored space.

8. The method of claim 1, wherein the active infrared sensor comprises:

an emitter configured to emit the modulated infrared signals; and a receiver configured to receive the modulated infrared signals reflected from the objects in the monitored space.

9. An apparatus for monitoring a monitored space using a home automation system, comprising:

a processor;

a memory in electronic communication with the processor; and instructions stored in the memory, the instructions being executable by the processor to:

periodically emit with an active infrared sensor a modulated infrared signal into the monitored space;

receive with the active infrared sensor the modulated infrared signals reflected from objects in the monitored space; and determine a change in a number of objects in the monitored space and a direction of movement of objects in the monitored space using at least one of amplitude modulation and Doppler effect.

10. The apparatus of claim 9, wherein the instructions are executable by the processor to:

emit and receive the modulated infrared signals multiple times per second.

11. The apparatus of claim 9, wherein the instructions are executable by the processor to:

determine at least one of presence and direction of movement of two or more objects in the monitored space concurrently.

12. The apparatus of claim 9, wherein the determining step includes comparing the received modulated infrared signals to one or more baseline signals.

13. An active infrared (IR) sensor for use in a home automation and security system, comprising:

an infrared emitter configured to disperse at least one infrared beam into a monitored space;

an infrared receiver configured to receive reflected infrared signals from the monitored space; and a controller configured to:

generate a baseline profile of the monitored space based on the received reflected infrared signals; and compare future profiles to the baseline profile to determine whether a number of objects in the monitored space has changed and whether any of the objects are moving.

14. The active infrared sensor of claim 13, wherein the controller is configured to determine a frequency shift in the received reflected infrared signals.

15. The active infrared sensor of claim 14, wherein the controller uses the frequency shift to determine a direction of motion of one or more objects in the monitored space.

16. The active infrared sensor of claim 13, wherein the active infrared sensor is integrated into a housing of a control panel of the home automation and security system.

17. The active infrared sensor of claim 16, wherein the infrared emitter is positioned spaced apart from the infrared receiver on the housing of the control panel.

18. The active infrared sensor of claim 13, wherein the infrared emitter emits infrared signals in at least a 180° pattern.

19. The active infrared sensor of claim 13, wherein the infrared emitter is configured to emit a modulated infrared signal.

20. The active infrared sensor of claim 13, wherein the controller utilizes at least one of amplitude modulation and Doppler effect to determine at least one of a direction of motion and a change in the number of objects present in a space monitored by the active infrared sensor.

* * * * *